US005878756A

United States Patent [19]

Bilodeau

[11] Patent Number: 5,878,756

[45] Date of Patent: Mar. 9, 1999

[54] ATHLETIC HAIR TIE

[76] Inventor: Brian E. Bilodeau, P.O. Box 5272, Oxnard, Calif. 93031

[21] Appl. No.: 44,330

[22] Filed: Mar. 19, 1998

[51] Int. Cl.[6] ..... A45D 8/40

[52] U.S. Cl. ..... 132/274; 132/273; 132/222; 132/212; 2/172; 2/209.13

[58] Field of Search ..... 132/273, 274, 132/212, 275, 222; 2/171, 172, 209.13, 207, 170, 174, DIG. 11, 195.8; D2/512, 513, 514, 515; 54/78

[56] References Cited

U.S. PATENT DOCUMENTS

| | | | |
|---|---|---|---|
| 1,600,530 | 9/1926 | Becker et al. | 132/274 |
| 1,610,480 | 12/1926 | Seilaz | 132/274 |
| 1,618,297 | 2/1927 | Reinhold | 132/274 |
| 5,465,741 | 11/1995 | Dvorak | 132/273 |
| 5,472,003 | 12/1995 | Frame et al. | 132/273 |
| 5,594,956 | 1/1997 | Barrientos | 2/171 |
| 5,621,920 | 4/1997 | Gorsuch et al. | 2/195.8 |
| 5,623,732 | 4/1997 | Olajide, Jr. | 2/209.13 |
| 5,694,750 | 12/1997 | Allen | 132/273 |
| 5,727,575 | 3/1998 | Rontal | 132/273 |
| 5,730,161 | 3/1998 | Kohanek | 132/273 |

*Primary Examiner*—Cary E. O'Connor
*Assistant Examiner*—Pedro Philogene

[57] ABSTRACT

A hair tie is provided including an elongated tubular hair sleeve constructed from a flexible material for encompassing hair of a user. Also included is a plurality of securement mechanisms situated along a length of the sleeve for securing the sleeve about the hair of the user.

4 Claims, 2 Drawing Sheets

ATHLETIC HAIR TIE

BACKGROUND OF THE INVENTION

1. Field of the Invention

The present invention relates to hair ties and more particularly pertains to a new athletic hair tie for containing hair of a user during athletic activities or the like.

2. Description of the Prior Art

The use of hair ties is known in the prior art. More specifically, hair ties heretofore devised and utilized are known to consist basically of familiar, expected and obvious structural configurations, notwithstanding the myriad of designs encompassed by the crowded prior art which have been developed for the fulfillment of countless objectives and requirements.

Known prior art hair ties include U.S. Pat. Nos. 5,293,884; 5,167,245; 4,998,544; 5,044,385; 5,301,696; and U.S. Pat. No. Des. 344,176.

In these respects, the athletic hair tie according to the present invention substantially departs from the conventional concepts and designs of the prior art, and in so doing provides an apparatus primarily developed for the purpose of containing hair of a user during athletic activities or the like.

SUMMARY OF THE INVENTION

In view of the foregoing disadvantages inherent in the known types of hair ties now present in the prior art, the present invention provides a new athletic hair tie construction wherein the same can be utilized for containing hair of a user during athletic activities or the like.

The general purpose of the present invention, which will be described subsequently in greater detail, is to provide a new athletic hair tie apparatus and method which has many of the advantages of the hair ties mentioned heretofore and many novel features that result in a new athletic hair tie which is not anticipated, rendered obvious, suggested, or even implied by any of the prior art hair ties, either alone or in any combination thereof.

To attain this, the present invention generally comprises a cap formed from a flexible cloth material. The cap has a hollow hemispherical configuration thus defining a hollow interior with a free lower peripheral edge. The cap is thus adapted for being removably situated on a head of a user. As shown in FIGS. 3& 4, the lower peripheral edge has a thin rectangular band mounted thereon with a pair of free ends. Such rectangular band extends from a rear extent of the lower peripheral edge of the cap for being selectively tied thereby securing the cap to the head of the user. Also included is a hair sleeve having an elongated rectangular strip constructed from the flexible cloth material. A top edge of the hair sleeve is integrally coupled to the rear extent of the lower peripheral edge of the cap and extends downwardly therefrom. As such, a pair of elongated free side edges and a short bottom edge are defined. The hair sleeve further includes a plurality of spaced pairs of rectangular tabs each mounted on opposite elongated free side edges thereof. Each pair of tabs extends perpendicularly from the longitudinal side edges in collinear relationship with respect to each other. By this structure, the pairs of tabs are adapted for being tied together, thereby rendering a tubular sleeve for containing hair of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new athletic hair tie apparatus and method which has many of the advantages of the hair ties mentioned heretofore and many novel features that result in a new athletic hair tie which is not anticipated, rendered obvious, suggested, or even implied by any of the prior art hair ties, either alone or in any combination thereof.

It is another object of the present invention to provide a new athletic hair tie which may be easily and efficiently manufactured and marketed.

It is a further object of the present invention to provide a new athletic hair tie which is of a durable and reliable construction.

An even further object of the present invention is to provide a new athletic hair tie which is susceptible of a low cost of manufacture with regard to both materials and labor, and which accordingly is then susceptible of low prices of sale to the consuming public, thereby making such athletic hair tie economically available to the buying public.

Still yet another object of the present invention is to provide a new athletic hair tie which provides in the apparatuses and methods of the prior art some of the advantages thereof, while simultaneously overcoming some of the disadvantages normally associated therewith.

Still another object of the present invention is to provide a new athletic hair tie for containing hair of a user during athletic activities or the like.

Even still another object of the present invention is to provide a new athletic hair tie that includes an elongated tubular hair sleeve constructed from a flexible material for encompassing hair of a user. Also included is a plurality of securement mechanisms situated along a length of the sleeve for securing the sleeve about the hair of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
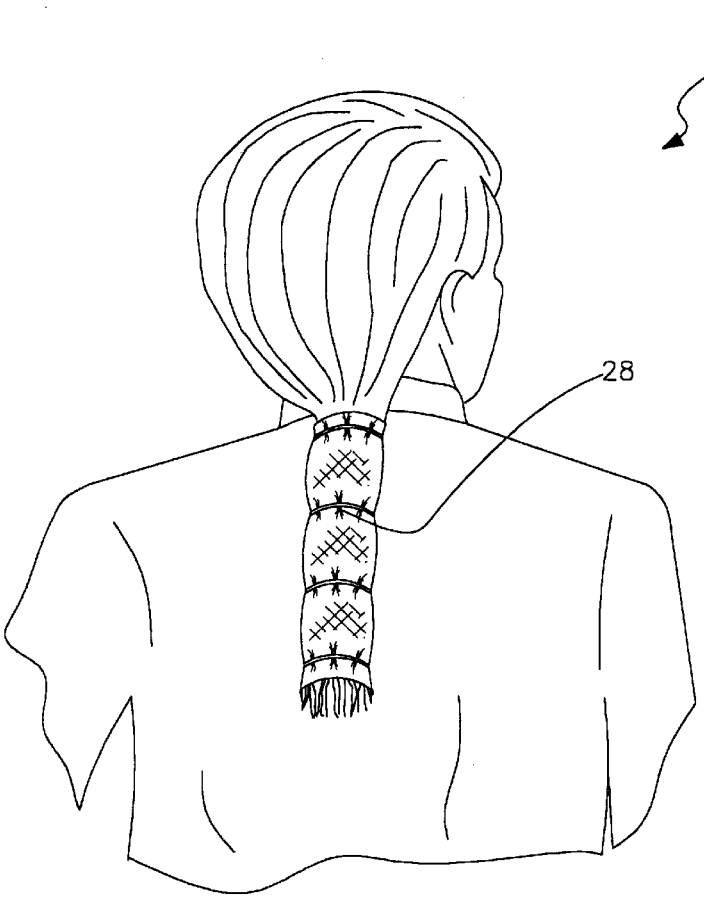
FIG. 1 is a rear view of an embodiment of the present invention
Figure 2:
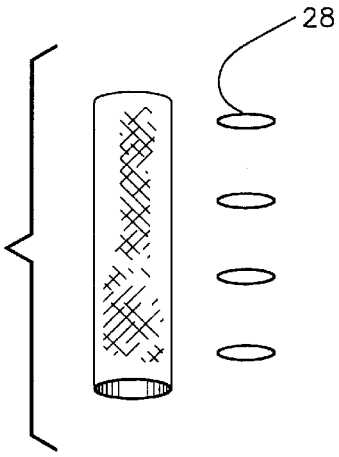
FIG. 2 is an exploded view of the embodiment of the present invention shown in FIG. 1.

With reference now to the drawings, and in particular to FIGS. 1 through 4 thereof, a new athletic hair tie embodying the principles and concepts of the present invention and generally designated by the reference numeral 10 will be described.

The present invention, designated as numeral 10, includes a cap 12 formed from a flexible cloth material. The cap has a hollow hemispherical configuration thus defining a hollow interior with a free lower peripheral edge 14. The cap is thus adapted for being removably situated on a head of a user. As an option, the cap may be constructed from neoprene or an elastic material.

Figure 3:
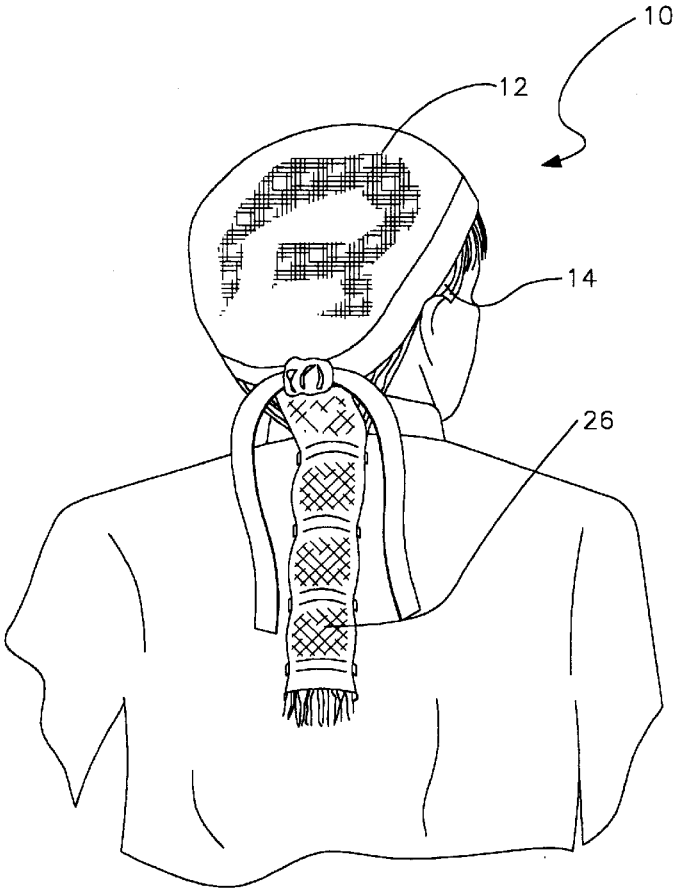
FIG. 3 is a rear perspective view of another embodiment of the present invention in use.
Figure 4:
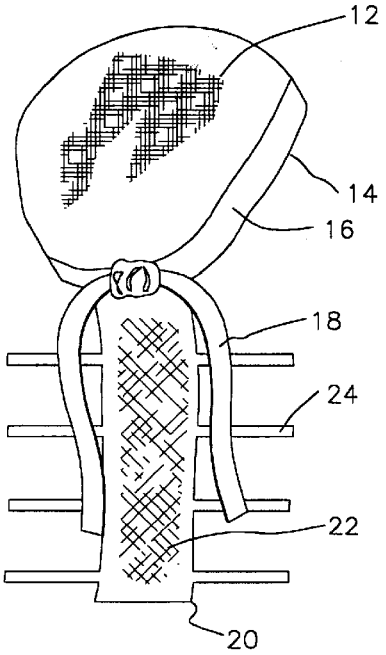
FIG. 4 is a rear perspective view of the embodiment of the present invention shown in FIG. 3.

As shown in FIGS. 3 & 4, the lower peripheral edge has a thin rectangular band 16 mounted thereon. The band may be fixedly attached to the cap or, in the alternative, through a sleeve which is mounted on the cap. The band preferably has a pair of free ends 18 which extend from a rear extent of the cap. Each free end ideally has a length of about ½ the circumference of the lower peripheral edge of the cap. The free edges serve for being selectively tied thereby securing the cap to the head of the user.

Also included is a hair sleeve 20 having an elongated rectangular strip 22 constructed from a flexible cloth or neoprene material similar to that of the cap. A width of the strip is preferably approximately equal to a space between points where the free ends of the band extend from the cap. A length of the strip is ideally approximately that of the free ends of the band. A top edge of the hair sleeve is integrally coupled to the rear extent of the lower peripheral edge of the cap and extends downwardly therefrom. As such, a pair of elongated free side edges and a short bottom edge are defined.

The hair sleeve further includes about four equally spaced pairs of rectangular tabs 24 each mounted on opposite elongated free side edges thereof. Each pair of tabs extends perpendicularly from the longitudinal side edges in collinear relationship with respect to each other. By this structure, the pairs of tabs are adapted for being tied together, thereby rendering a tubular sleeve 26 for containing hair of the user. The knots associated with the tabs are preferably hidden behind the hair sleeve during use.

In another embodiment, the side edges of the strip are integrally coupled to define a tubular sleeve with a pair of circular open ends for receiving and passing the hair of the user. See FIGS. 1 & 2. Next provided is a plurality of closed loop elastic bands 28 for being situated about the sleeve of the present embodiment thereby maintaining the same on the hair of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair tie comprising, in combination:

a cap having a hollow hemispherical configuration thus defining a hollow interior with a free lower peripheral edge for being removably situated on a head of a user, the lower peripheral edge having a thin rectangular band situated within a sleeve mounted on the lower peripheral edge, the thin rectangular band being equipped with a pair of free ends each having a length which is about ½ a circumference of the lower peripheral edge and extending from a rear extent of the lower peripheral edge of the cap for being selectively tied thereby securing the cap to the head of the user; and a hair sleeve including an elongated rectangular strip having a top edge integrally coupled to the rear extent of the lower peripheral edge of the cap and extending downwardly therefrom thereby defining a pair of elongated free side edges and a short bottom edge, the hair sleeve further including a plurality of spaced pairs of rectangular tabs each mounted on opposite elongated free side edges thereof and extending perpendicularly therefrom in collinear relationship with respect to each other for being tied together thereby rendering a tubular sleeve for containing hair of the user, wherein knots associated with the tabs are situated behind the hair sleeve.

2. A hair tie as set forth in claim 1 wherein the hair tie is constructed from neoprene.

3. A hair tie as set forth in claim 1 wherein the strip has a width equal to a space between points where the free ends of the band extend from the cap and a length equal to that of the free ends.

4. A hair tie comprising:

an elongated tubular hair sleeve constructed from a flexible material for encompassing hair of a user, the hair sleeve having a pair of circular open ends; and a plurality of removably closed loop elastic bands removably situated along a length of the hair sleeve in concentric relationship for securing the hair sleeve about the hair of the user.

* * * * *